US006303007B1

(12) United States Patent
Ohkawa

(10) Patent No.: US 6,303,007 B1
(45) Date of Patent: Oct. 16, 2001

(54) PLASMA INJECTOR

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/440,358

(22) Filed: Nov. 15, 1999

(51) Int. Cl.[7] ..... H05F 3/06

(52) U.S. Cl. ..... 204/164; 588/212; 204/157.3; 204/157.43

(58) Field of Search ..... 422/186.04, 186.29; 204/164, 157.43, 157.3; 588/212

(56) References Cited

U.S. PATENT DOCUMENTS 3,722,677 3/1973 Lehnert .
4,987,007 1/1991 Wagal et al. .
5,225,740 7/1993 Ohkawa .
5,250,773 * 10/1993 Lind et al. ..... 219/10.55 A
5,350,454 9/1994 Ohkawa .
5,361,016 11/1994 Ohkawa et al. .
5,468,356 * 11/1995 Uhm ..... 204/164
5,681,434 10/1997 Eastlund .
5,830,328 * 11/1998 Uhm ..... 204/164

FOREIGN PATENT DOCUMENTS

WO 97/34685 9/1997 (EP) .

* cited by examiner

*Primary Examiner*—Robert Dawson
*Assistant Examiner*—Michael J Feely
(74) *Attorney, Agent, or Firm*—Nydegger & Associates

(57) ABSTRACT

A plasma injector for creating a plasma discharge includes a hollow, substantially cylindrical-shaped waveguide, and a coaxial dielectric loaded cavity. The waveguide is specifically dimensioned to establish a predetermined cut off wavelength in the waveguide. A microwave power generator is connected with the cavity to generate a resonant microwave in the cavity which will establish a TE mode electrical field in the waveguide. Importantly, the resonant microwave has a wavelength that is below the cut off wavelength in order to prevent a propagation of the microwave through the waveguide. The injector also includes a feed line for introducing a waste material into the waveguide. Specifically, the waste material interacts with the TE mode electrical field in the waveguide to vaporize the waste material and thereby create the plasma discharge.

21 Claims, 2 Drawing Sheets

PLASMA INJECTOR

FIELD OF THE INVENTION

The present invention pertains generally to plasma injectors which are sometimes referred to as plasma torches. More particularly, the present invention pertains to plasma injectors that generate plasmas using microwave power. The present invention is particularly, but not exclusively, useful as a plasma injector for applications wherein the plasma must be generated with a relatively low density and for which, therefore, the injector requires a low gas through-put.

BACKGROUND OF THE INVENTION

Plasma injectors (torches) are primarily used for the purpose of processing refractive materials, which may be either in a liquid or a solid state, and for converting them into vapors which are then ionized by an arc to generate a plasma. The process of vaporizing liquid or solid refractive materials, however, should take place at very high temperatures (>3000K) in order to avoid excessive radiation power losses. In order to achieve such temperatures, the process of vaporizing and ionizing refractive materials is typically started by first ionizing a more volatile gas. A consequence of this is the resultant plasma will include gas ions along with the ions that have been created from the refractive materials.

For applications wherein it is desirable that the plasma include as many refractive material ions as possible in a relatively low density plasma, e.g. densities where the ratio of ion collisional frequency ($\nu$) to the cyclotron frequency ($\Omega$) is greater than one ($\nu/\Omega>1$), it is necessary for there to be a relatively low gas through-put.

One well known type of plasma torch is the so-called cylindrical ICP Inductively Coupled Plasma), or TCP (Transformer Coupled Plasma) injector. or the cylindrical ICP injector, a generally azimuthal electric field is induced in a cylindrical chamber by a solenoid coil. A gas is then provided in the chamber to initiate the plasma. The strength the electric field induced by the ICP injector, however, has its maximum value at the wall of the chamber and declines toward the center of the chamber. Thus, most of the plasma is created at the wall of the ICP injector. The consequences of this are that very high heat loads are experienced at the wall of the ICP injector and resultant instabilities can be experienced in the chamber. These instabilities are further aggravated by the fact that the solenoid coil also produces a non-axisymmetric electrostatic potential which prevents the induced electric field from being effectively azimuthal. To overcome these adverse consequences, a high gas through-put is introduced near the wall of an ICP injector with angular momentum. This serves the purposes of: 1) initiating and maintaining the plasma, 2) cooling the chamber wall, and 3) helping to stabilize the discharge. As indicated above, however, a high gas through-put for a plasma injector may not always be operationally desirable.

An alternative to the cylindrical ICP injector discussed above is the so-called planar ICP injector which has been widely used for plasma processing semiconductors. The planar ICP injector, unlike the cylindrical ICP injector, is characterized by a planar spiral coil antenna which is placed outside a cylindrical conducting vacuum vessel. The diameter of the antenna can be anywhere between about one half and two thirds of the diameter of the vacuum vessel and the antenna is positioned so that the electromagnetic field it generates will penetrate into the vacuum vessel through a dielectric window. With this configuration, an azimuthal electric field is created in the vessel which has its maximum field strength at the edge of the antenna, and which vanishes at the vessel wall. Interestingly, it happens that the shape of this electric field is similar in several respects to a transverse electric mode (TE) that can be generated by a resonant microwave.

When considering the use of microwaves for the purpose of generating an azimuthal electric field that can generate a plasma, it is necessary to evaluate the thickness of the region in which a plasma can be generated (i.e. the so-called "skin depth"). It happens that at microwave frequencies the skin depth becomes relatively small. Nevertheless, by way of example, if a microwave frequency is taken to be approximately 2.45 GHz, and the plasma conductivity is approximately one Siemens (corresponding to the degree of ionization of $10^{-6}$), the skin depth will be around one cm. Operationally, this value is typical for the higher density plasma torches discussed above.

For the generation of a TE mode electrical field using microwaves, consider a cylindrical cavity having a radius a and a longitudinal axis extending in the z direction. Further, consider the cavity is loaded with a dielectric material which extends from z=−h to z=O, and that it has a conducting end plate at z=−h. In the absence of a plasma in the waveguide, the electric and magnetic fields in the dielectric material in the cavity are given by:

$$E_0 E J_1[Ir]\cos[kz+\phi]\cos\omega t$$

$$B_r=-[k/\omega]EJ_1[Ir]\sin[kz+\phi]\sin\omega t$$

$$B_z=-[I/\omega]EJ_0[Ir]\cos[kz+\phi]\sin\omega t$$

$$I^2+k^2=\epsilon'\omega^2/c^2\equiv\epsilon' k_0^2$$

$$-kh+\phi=\pi/2$$

In the vacuum region of the waveguide, where z≧0, the electric and magnetic fields are given by:

$$E_\theta'=E'J_1[Ir]\exp[-k'z]\cos\omega t$$

$$B_r'=-[k'/\omega]E'J_1[Ir]\exp[-k'z]\sin\omega t$$

$$B_z'=-[I/\omega]E'J_0[Ir]\exp[-k'z]\sin\omega t$$

$$k'^2=I^2-k_0^2$$

By equating the fields at the interface we obtain:

$$\tan\phi=k'/k$$

and $$E'=E\cos\phi$$

If the microwave that is generated in the cavity has a cut-off wavelength which corresponds to the lowest frequency that can be supported by the waveguide for the TE mode then, k'=0 and $\phi$=0. In this case, the length of the dielectric loaded cavity is a quarter wavelength. If the wave frequency is slightly below cut-off, however, the length of the loaded cavity is a bit shorter than the quarter wavelength.

When the plasma discharge is started in the waveguide, the region z≧0 is filled with plasma. By treating the plasma as a conducting medium with the conductivity $\sigma$, the electric and magnetic fields are given by $$E_\theta''=E'J_1[Ir]\exp[-k''z]\cos[k''z+\psi]\cos\omega t$$

$$B_r''=[\kappa/\omega]E''J_1[Ir]\exp[-\kappa z]\{\cos[\kappa z+\psi]+\sin[\kappa z+\psi]\}\sin\omega t$$

$$B_z''=-[I/\omega]E''[Ir]\exp[-\kappa z]\cos[\kappa z+\omega]\sin \omega t$$

$$\kappa^2=\mu_0\omega\sigma/2$$

By matching the fields at the interface for the case where there is plasma in the waveguide, we obtain $$\tan \phi=-[\kappa/k][1+\tan \omega]$$

$$E \cos \phi=E'' \cos \omega$$

For the condition where plasma is present in the waveguide, if the skin depth is small, namely $\kappa>>k$; $\phi\rightarrow-\pi/2$, the cavity length should approach approximately a half wavelength.

Due to the change in conditions that is caused by generating a plasma in the waveguide, it is clear from the above equations that it is necessary to somehow tune the cavity from approximately a quarter wavelength to approximately a half wavelength. It is known that this can be done in several ways. For one, the cavity can be tuned by changing the length of the cavity. Also, the cavity can be tuned by introducing water either into the cavity or with the refractive materials that are being vaporized to create the plasma.

In light of the above it is an object of the present invention to provide a plasma injector which generates an azimuthal TE electric field using microwave power. Another object of the present invention is to provide a plasma injector (torch) which is operational with a low gas through-put. Still another object of the present invention is to provide a plasma injector which will generate a stable discharge. Yet another object of the present invention is to provide a plasma injector which uses an axisymmetric electric field for the generation of a plasma. Another object of the present invention is to provide a plasma injector which is simple to use, is relatively easy to manufacture, and is comparatively cost effective.

SUMMARY OF THE PREFERRED EMBODIMENTS

In accordance with the present invention, a plasma injector for creating a plasma discharge includes a hollow, substantially cylindrical-shaped waveguide. This waveguide is attached to, and is coaxially aligned with, a dielectric loaded, substantially cylindrical-shaped cavity. With this combined waveguide-cavity structure, any electromagnetic field that may be generated by a resonant microwave in the cavity will penetrate into the waveguide. A conducting end plate is positioned at the end of the cavity opposite from the waveguide.

For purposes of the present invention, the waveguide is dimensioned to establish a predetermined cut off wavelength. As so dimensioned, the waveguide will prevent propagation of microwaves through the waveguide, if the microwaves have wavelengths longer than the cut off wavelength. Accordingly, in compliance with the cut off wavelength established by the waveguide, the cavity can be tuned to generate a resonant microwave in the cavity that will establish a TE mode electric field in the waveguide. For this purpose, a microwave power generator is provided and is preferably connected with the conducting end plate of the cavity.

It is an important aspect of the present invention that, the resonant microwave generated in the cavity will establish a TE electric field in the waveguide. Further, the TE mode electrical field requires specific characteristics that are important to the operation of the plasma injector. Specifically, the TE mode electric field should be axisymmetric and have its maximum field strength approximately midway between the longitudinal axis and the wall of the waveguide. The TE mode electric field should also be at its minimum strength both at the wall and at the longitudinal axis of the waveguide. Thus, the TE mode electric field is preferably configured in the waveguide to define both a central region and an outer region. Specifically, the outer region is located between the wall of the waveguide and the electric field, while the central region surrounds and extends along the longitudinal axis. Accordingly, the central region is distanced from the wall of the waveguide, and is separated from the outer region by the TE mode electric field.

The plasma injector of the present invention also includes a feed line which will be used for introducing a waste material into the waveguide. As contemplated for the present invention, the feed line may extend along the longitudinal axis through the cavity without interfering with the generation of the resonant microwave in the cavity. The waste material (which can be either liquid or solid) can then be introduced through the feed line and into the waveguide where it will interact with the TE electrical field. With this interaction, the waste material is vaporized and ionized to thereby create the plasma discharge. In addition to the waste material that is introduced into the waveguide through the feed line, a sodium vapor may also be introduced, as required, to initiate or maintain the plasma discharge.

As indicated above, the cavity of the plasma injector is dielectric loaded and may occasionally need to be tuned. In detail, the cavity includes a ceramic lined metal cylinder that is preferably filled with a plurality of disks. If tuning is required, one method is to selectively insert disks into the cavity which can be used to vary the length of the cavity and, thus, maintain the resonant condition for the microwave in the cavity. As will be appreciated by the skilled artisan, rather than dielectrically loading the cavity, the cavity can be made with a larger diameter than the waveguide and thereby accomplish the same purposes for the present invention. Other methods for tuning the cavity to maintain a resonant condition therein include varying the microwave power from the generator and varying an amount of liquid in the waste material as it is vaporized and ionized.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
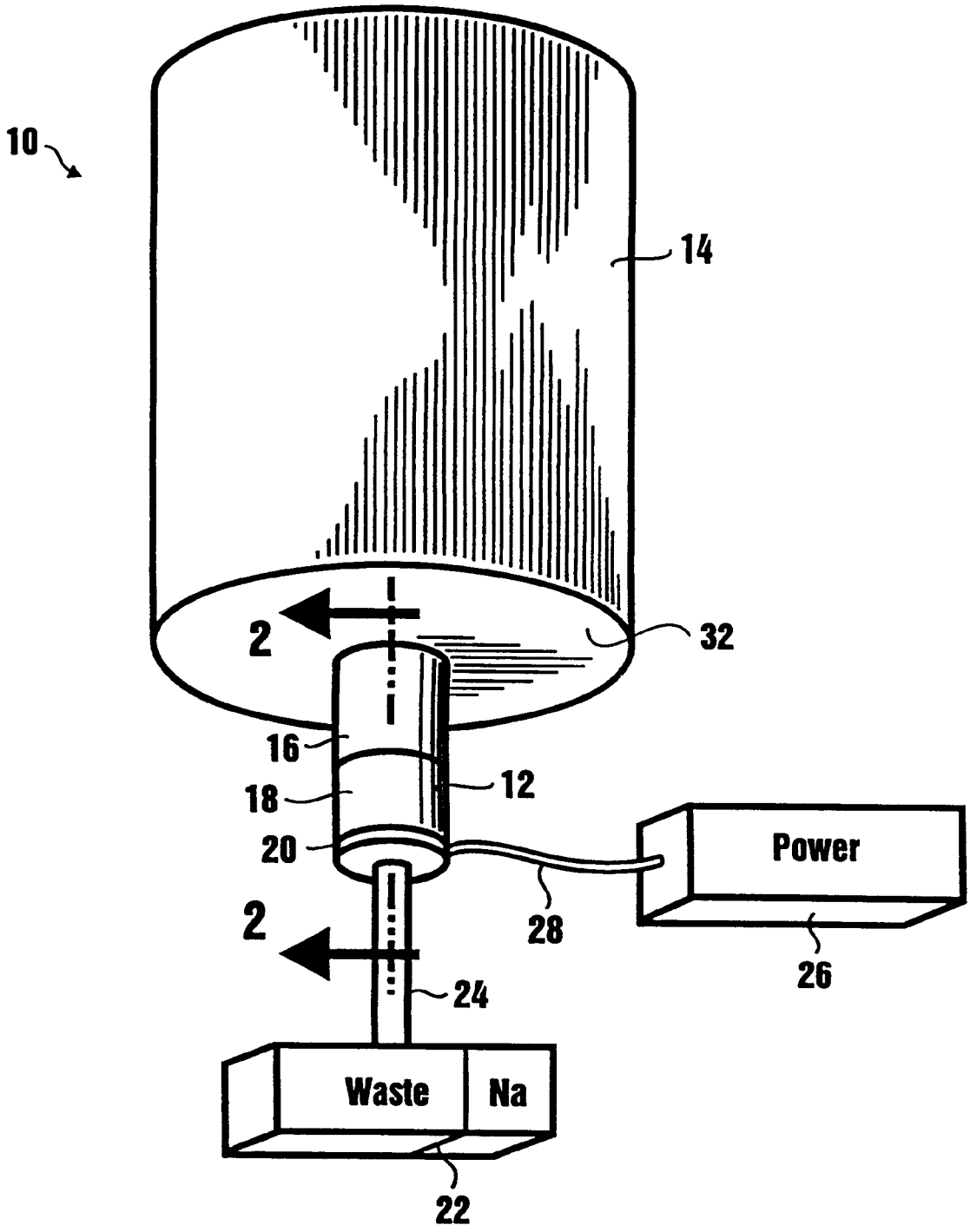
FIG. 1 is a perspective view of a system employing the plasma injector of the present invention.

Referring initially to FIG. 1, a system for processing plasma is shown and is generally designated 10. Included in the system 10 is a plasma injector (torch) 12 that is attached or connected in fluid communication with a plasma chamber 14 wherein the plasma is processed. In accordance with the present invention, the plasma injector 12 includes a waveguide 16 which is attached directly to the plasma chamber 14, and it includes a cavity 18 which is positioned so that the waveguide 16 is located between the plasma chamber 14 and the cavity 18. Further, injector 12 includes an end plate 20 which is positioned so that the cavity 18 is between the waveguide 16 and the end plate 20.

Still referring to FIG. 1 it will be seen that the system 10 includes a waste source 22 that is attached to a feed line 24 which passes through the plasma injector 12. After passing through the plasma injector 12, the feed line 24 is connected in fluid communication with the plasma chamber 14. FIG. 1 also shows that a microwave power source 26 is connected via a line 28 with the cavity 18.

Figure 2:
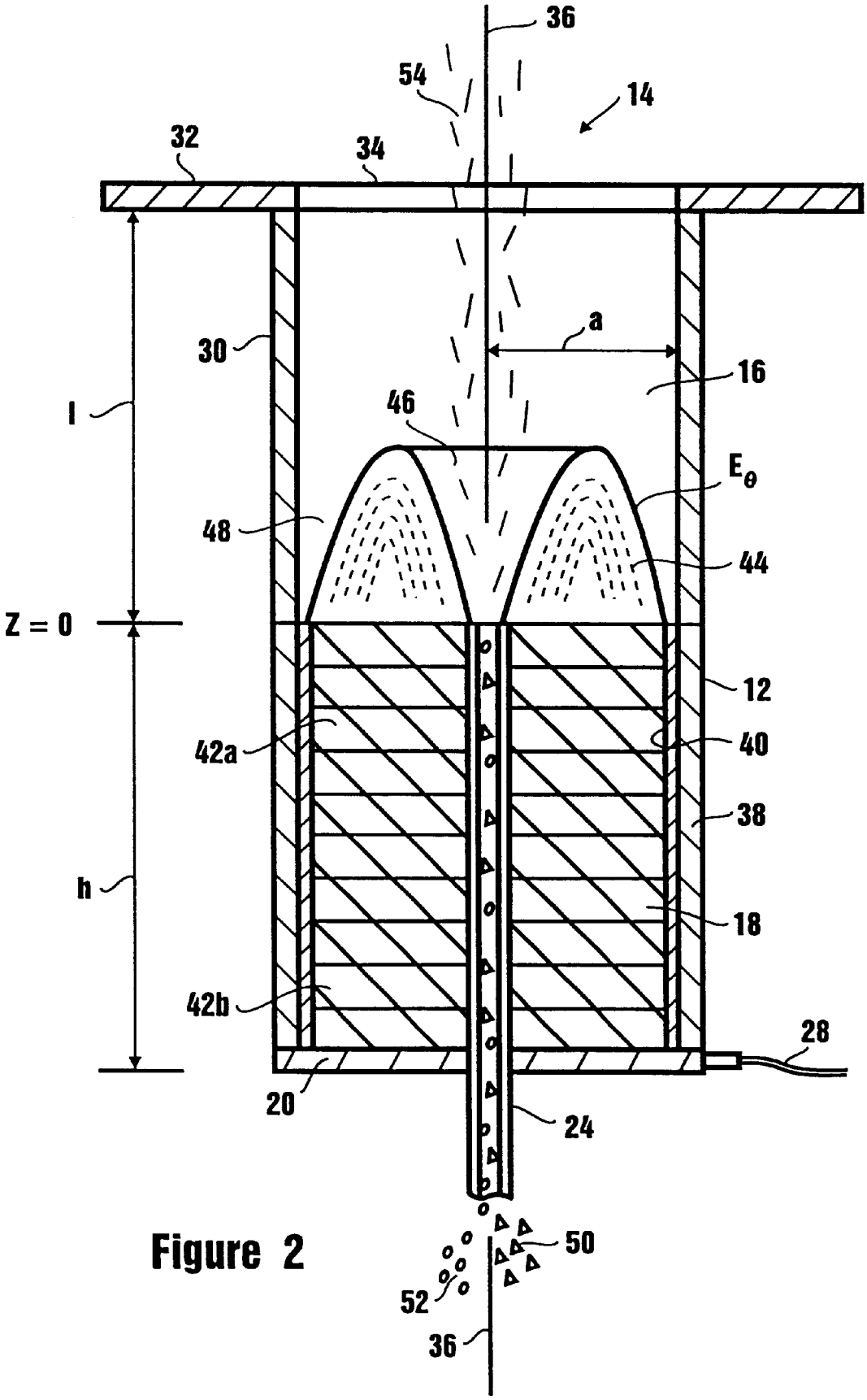
FIG. 2 is a cross sectional view of the plasma injector of the present invention as seen along the line 2—2 in FIG. 1.

In more detail, FIG. 2 shows that the waveguide 16 is established by a hollow, substantially cylindrical-shaped wall 30 which has a length "I". As shown, one end of the wall 30 is attached to an injection port 32 on the plasma chamber 14. Further, the wall 30 surrounds an aperture 34 formed in the injection port 32 so that the waveguide 16 is in direct fluid communication with the plasma chamber 14. Importantly, the length I is dimensioned as a cut-off length so that the waveguide 16 will act to cut-off selected microwaves. For orientation purposes, the waveguide 16 and the cavity 18 define a longitudinal axis 36 and, as shown, both the waveguide 16 and the cavity 18 are coaxially aligned on the axis 36.

Still referring to FIG. 2 it will be seen that the cavity 18 is formed by a substantially cylindrical-shaped, metal wall 38 having a length "h". As intended for the present invention, the length "h" and the radius "a" of the cavity 18 are selected to set up a resonant microwave in the cavity 18. Preferably, the metal wall 38 has a ceramic lining 40 which will help shield the metal wall 38 from heat losses in the cavity 18. Further, the cavity 18 of the injector 12 includes a plurality of dielectric disks 42, of which the disks 42*a* and 42*b* are exemplary. More specifically, the disks 42 are formed with respective holes through which the feed line 24 may pass and may be selectively inserted into the cavity 18 to vary the length "h" and thereby maintain a resonant condition in the cavity 18.

As indicated in FIG. 2, the disks 42 are generally flat and are oriented substantially perpendicular to the feed line 24 and, thus, also to the longitudinal axis 36. Importantly, the disks 42 fill the cavity 18 so that the cavity 18 is dielectric loaded. For purposes of the present invention the disks 42 can be made of any suitable dielectric material and alternative embodiments for the shape of this dielectric material are possible so long as the cavity 18 is effectively dielectric loaded.

In the operation of the plasma injector 12, the microwave power source 26 is activated to set up a resonant microwave (not shown) in the cavity 18. Importantly, the resonant microwave is established to generate an electric field 44 which will penetrate into the waveguide 16. For the purposes of the present invention this electric field 44 is azimuthal ($E_\theta$) and is a transverse electric field of the type which is commonly referred to by skilled artisans as the TE mode. More specifically, by referring to FIG. 2 it can be seen that for the TE mode of the electric field 44, the maximum field strength is achieved at a radius which extends to approximately midway between the longitudinal axis 36 and the wall 30 of the waveguide 16. For a waveguide 16 having a radius "a", this maximum strength for the electric field 44 will be at approximately a distance of a/2 from the axis 36. The TE mode electric field 44 should also have its minimum strength both at the wall 30 and at the longitudinal axis 36. Thus, as shown, the TE mode electric field 44 is configured in the waveguide 16 to define both a central region 46 and an outer region 48. Specifically, as shown, the outer region 48 is located between the wall 30 of waveguide 16 and the electric field 44, while the central region 46 surrounds and extends along the longitudinal axis 36. An important consequence of the TE mode electrical field 44 is that the central region 46 is distanced from the wall 30 of the waveguide 16.

Once the TE mode electrical field 44 is established inside the waveguide 16, waste 50 is introduced into the waveguide 16 via the feed line 24. As intended for the present invention, the waste 50 may be refractive materials and may be either in a solid or a liquid state. Additionally, a gaseous vapor, such as sodium vapor 52, can be introduced through the feed line 24 either by itself or together with waste 50, as desired. Preferably, only the more volatile sodium vapor 52 is initially introduced through the feed line 24 and into the waveguide 16. This is done for the purpose of initiating the ionization process. Once there has been an initial ionization of the sodium vapor 52, there is a basis for generating the very high temperatures (>3000K) that are required for subsequent ionization of the waste 50 that will create the plasma discharge 54.

An important aspect of the present invention is that due to the configuration of the TE electric field 44, the ionization of both the sodium vapor 52 and the waste 50 will occur primarily in the central region 46. Thus, the high heat loads that accompany this ionization will be distanced from the wall 30. Further, the central region 46 provides for stability of the plasma discharge 54 in that it will help prevent the plasma discharge 54 from wandering off axis.

Once ionization of the waste 50 has begun, additional sodium vapor 52 may be introduced through the feed tube 24, as necessary, to maintain the ionization process in the waveguide 16. In any event, the resultant plasma discharge 54 which is generated in the waveguide 16 will pass through the aperture 34 and into the plasma chamber 14 for further processing. As indicated above, the tuning of cavity 18 to set up a resonant microwave can be accomplished in several ways. For one, the length "h" of cavity 18 can be varied. To do this, additional disks 42 can be added to the dielectric load of the cavity 18. Also, water (not shown) can be added to the waste 50 and sodium vapor 52 as required. In these ways, as with others known in the pertinent art, the cavity 18 can be tuned so that the resonant microwave that is established in the cavity 18 will establish the appropriate TE mode electrical field 44 in the waveguide 16.

In addition to the tuning of the cavity 18, it is an important aspect of the present invention that the waveguide 16 establish a cut-off wavelength in order to prevent the propagation of microwaves into the plasma chamber 14. Accordingly, the microwave source 26 needs to be adjusted in a manner which will reconcile the resonant microwave in the cavity 18, the TE mode electrical field 44 in the waveguide 16 and the cut-off wavelength for microwaves confined to the waveguide 16.

While the particular Plasma Injector as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A plasma injector for creating a plasma discharge which comprises:

a hollow, substantially cylindrical-shaped waveguide, said waveguide defining a longitudinal axis and being dimensioned to establish a predetermined cut off wavelength;

a substantially cylindrical-shaped cavity, said cavity being loaded with a dielectric and attached to said waveguide in a substantially coaxial alignment therewith;

a microwave power generator connected with said cavity for generating a resonant microwave in said cavity to establish a TE mode electrical field in said waveguide, said microwave having a wavelength below said cut off wavelength to prevent propagation of said microwave through said waveguide;

and a feed line for introducing a waste material into said waveguide, said waste material interacting with said TE electrical field in said waveguide to vaporize said waste material and thereby create the plasma discharge.

2. An injector as recited in claim 1 wherein a sodium vapor is introduced into said waveguide through said feed line.

3. An injector as recited in claim 1 wherein said waste material includes a liquid.

4. An injector as recited in claim 1 wherein said waste material includes a solid.

5. An injector as recited in claim 1 further comprising a ceramic lined metal cylinder disposed in said cavity.

6. An injector as recited in claim 5 wherein said dielectric is formed as a plurality of disks, wherein said cavity has a length, and wherein said disks are selectively inserted into said cavity to vary said length thereof for maintaining said resonant condition in said waveguide.

7. An injector as recited in claim 1 further comprising means for varying microwave power from said generator to maintain said resonant condition in said cavity.

8. An injector as recited in claim 1 wherein the waste material includes a liquid and said injector further comprises means for varying an amount of the liquid in the waste material to maintain the resonant condition in said cavity.

9. An injector as recited in claim 1 wherein said feed line passes through said cavity and is located substantially along said axis.

10. An injector as recited in claim 1 wherein said waveguide is connected in fluid communication with a plasma chamber for introducing the plasma discharge into said plasma chamber.

11. A plasma injector for creating a plasma discharge which comprises:

a waveguide dimensioned to establish a cut off wavelength;

a means for setting up a resonant microwave in a dielectric loaded cavity, said cavity being connected with said waveguide to convert said resonant microwave in said cavity to a TE mode electrical field in said waveguide; and a means for introducing a waste material into said waveguide, said waste material interacting with said TE mode electrical field in said waveguide to vaporize said waste material and thereby create the plasma discharge.

12. An injector as recited in claim 11 wherein said setting up means is a microwave power generator.

13. An injector as recited in claim 11 wherein said microwave has a frequency of approximately 2.45 GHz.

14. An injector as recited in claim 11 wherein said waveguide is substantially cylindrical-shaped and defines a longitudinal axis, wherein said cavity is substantially cylindrical-shaped and is substantially coaxially aligned with said waveguide, and wherein said introducing means is a feed line, said feed line passing through said cavity and being located substantially along said axis.

15. An injector as recited in claim 11 wherein said a sodium vapor is introduced into said waveguide through said feed line.

16. An injector as recited in claim 11 wherein said waste material includes a liquid.

17. An injector as recited in claim 11 wherein said waste material includes a solid.

18. A method for creating a plasma discharge with a plasma injector which comprises the steps of:

providing a hollow, substantially cylindrical-shaped waveguide, said waveguide defining a longitudinal axis and being dimensioned to establish a cut off wavelength;

setting up a resonant microwave in a dielectric loaded cavity, said cavity being substantially cylindrical-shaped and attached in a substantially coaxial alignment with said waveguide;

converting said resonant microwave in said cavity to a TE mode electrical field in said waveguide, said microwave having a wavelength below said cut off wavelength to prevent propagation of said microwave through said waveguide; and introducing a waste material into said waveguide, said waste material interacting with said TE mode electrical field in said waveguide to vaporize said waste material and thereby create the plasma discharge.

19. A method as recited in claim 18 further comprising the step of tuning said injector to maintain said resonant condition in said cavity.

20. A method as recited in claim 19 wherein said dielectric loaded cavity comprises a plurality of disks, wherein said cavity has a length, and wherein said disks are selectively inserted into said cavity to vary said length thereof for maintaining said resonant condition in said cavity.

21. A method as recited in claim 19 wherein the waste material includes a liquid and said tuning step is accomplished by varying an amount of the liquid in the waste material to maintain said resonant condition in said cavity.

* * * * *

UNITED STATES PATENT AND TRADEMARK OFFICE

CERTIFICATE OF CORRECTION

PATENT NO. : 6,303,007 B1
DATED : October 16, 2001
INVENTOR(S) : Tihiro Ohkawa

It is certified that error appears in the above-identified patent and that said Letters Patent is hereby corrected as shown below:

Column 1,
Line 35, delete " Inductively " insert -- (Inductively --
Line 36, delete " or " insert -- For --

Column 2,
Line 28, delete " $E_o EJ_I$ [Ir] cos[kz + $\phi$] cos $\omega$t " insert -- $E_\theta = EJ_I$ [Ir] cos[kz + $\phi$] cos $\omega$t --

Column 3,
Line 1, delete " $B_z$" = -[I / $\omega$] E" [Ir] exp[-$\kappa$z] cos[$\kappa$z +$\omega$] sin $\omega$t " insert -- $B_z$" = -[I / $\omega$] E" [Ir] exp[-$\kappa$z] cos[$\kappa$z + $\psi$] sin $\omega$t --
Line 8, delete " tan $\phi$ = -[$\kappa$ / k] [1 + tan $\omega$] " insert -- tan $\phi$ = -[$\kappa$ / k] [1 + tan $\psi$] --
Line 9, delete " E cos $\phi$ = E" cos $\omega$ " insert -- E cos $\phi$ = E" cos $\psi$ --
Line 11, delete " $\kappa >> k\ \phi \rightarrow -\pi / 2$ " insert -- $\kappa >> k,\ \phi \rightarrow -\pi / 2$ --

Signed and Sealed this

Fourth Day of June, 2002

*Attest:*

*Attesting Officer*

JAMES E. ROGAN
*Director of the United States Patent and Trademark Office*